US007953239B2

(12) United States Patent
Decanio

(10) Patent No.: US 7,953,239 B2
(45) Date of Patent: May 31, 2011

(54) HIGH OUTPUT SUB-WOOFER

(75) Inventor: William Andrew Decanio, Castaic, CA (US)

(73) Assignee: Harman International Industries, Incorporated, Northridge, CA (US)

( * ) Notice: Subject to any disclaimer, the term of this patent is extended or adjusted under 35 U.S.C. 154(b) by 1029 days.

(21) Appl. No.: 11/676,201

(22) Filed: Feb. 16, 2007

(65) Prior Publication Data

US 2008/0199033 A1 Aug. 21, 2008

(51) Int. Cl.
*H04R 25/00* (2006.01)

(52) U.S. Cl. ..... 381/349; 381/345; 381/348

(58) Field of Classification Search ..... 381/345–346, 381/348, 349, 353, 354, 160
See application file for complete search history.

(56) References Cited

U.S. PATENT DOCUMENTS

| | | | | |
|---|---|---|---|---|
| 4,939,783 | A * | 7/1990 | Dunning | 381/349 |
| 5,253,301 | A * | 10/1993 | Sakamoto et al. | 381/349 |
| 6,626,263 | B2 * | 9/2003 | Sahyoun | 381/349 |
| 6,658,129 | B2 * | 12/2003 | D'Hoogh | 381/349 |
| 6,704,426 | B2 * | 3/2004 | Croft, III | 381/345 |
| 6,782,112 | B1 * | 8/2004 | Geddes | 381/349 |
| 7,039,212 | B2 * | 5/2006 | Poling et al. | 381/349 |
| 7,133,533 | B2 * | 11/2006 | Chick et al. | 381/349 |

* cited by examiner

*Primary Examiner* — Suhan Ni
(74) *Attorney, Agent, or Firm* — The Eclipse Group LLP

(57) ABSTRACT

A speaker system with an enclosure having at least six sides. At least two active transducers are mounted inside the enclosure. Each active transducer is oriented to project from one of the sides. At least four passive radiators are mounted inside the enclosure. Each passive radiator is oriented to project from one of the sides. The number of active transducers and passive radiators equals the number of sides on the enclosure.

15 Claims, 2 Drawing Sheets

HIGH OUTPUT SUB-WOOFER

FIELD OF THE INVENTION

This invention relates generally to audio speaker systems and more particularly to a sub-woofer speaker system.

BACKGROUND

The proliferation of home theater systems and the demand for deep, rich bass sounds in car audio systems has created a demand for more compact subwoofers. One challenge faced by speaker designers is making subwoofers more compact without losing volume displacement capability. In order to produce high acoustic output at very low frequencies, a subwoofer must be capable of moving large quantities of air. This means increasing the area of the radiating surfaces, which is the part of the speaker that actually pushes the air. All other things being equal, increased radiating surface area translates to an increased acoustic output capability.

One technique for increasing low frequency speaker output without a significant increase in speaker enclosure size involves the use of passive radiators. Passive radiators are speakers without voice coils that are tuned to resonate at very low frequencies. When placed in a subwoofer enclosure with a speaker, the passive radiator adds to the acoustic output by resonating with the air volume inside the enclosure when the speaker produces low frequency sound.

Subwoofers that use passive radiators typically employ an enclosure with a speaker on one face of the enclosure and the passive radiator on another face of the enclosure. Another face of the enclosure is also typically used for connections and controls for an internal amplifier. The use of an internally mounted amplifier can reduce the net volume inside the enclosure. Reduced internal volume tends to reduce low frequency output capability translating to less bass. Typically, this problem is addressed by making the enclosure larger to offset volume occupied by the amplifier. It would be advantageous to have a subwoofer with increased performance capabilities without requiring an increase in enclosure size.

SUMMARY

In view of the above, a speaker system is provided that includes an enclosure having at least six sides. At least two active transducers are mounted on opposite facing enclosure sides. At least four passive radiators are mounted on the remaining sides of the enclosure. Each passive radiator is mounted on opposite enclosure sides to allow acoustic summation and mechanical force cancellation. In one example of an implementation, the number of active transducers and passive radiators used in the system equals the number of sides on the enclosure. In another implementation, multiple active transducers may be utilized on opposing sides of the enclosure. Additionally, multiple passive radiators may be utilized on remaining sides of the enclosure.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION

Figure 1:
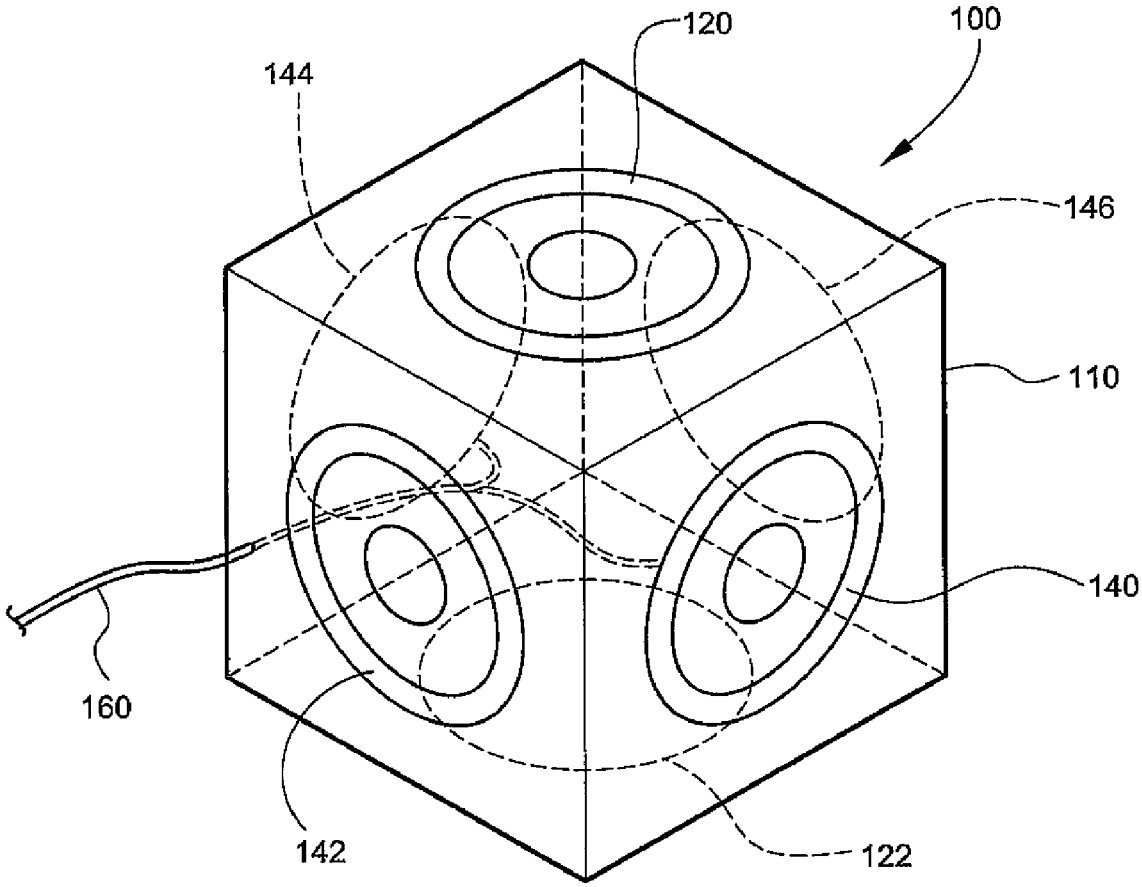
FIG. 1 is a perspective view of one example of one implementation of a high-output subwoofer system.

In FIG. 1, a speaker system 100 is shown. The system 100 has a substantially cube-shaped enclosure 110, two active transducers 120, 122 and four passive radiators 140, 142, 144, 146. A signal line 160 attaches through one side of the enclosure 110 and connects to the two active transducers 120, 122. The two active transducers 120, 122 are mounted inside the enclosure 110 on sides that are opposite each other. In FIG. 1, the active transducers 120, 122 are mounted on the top and bottom sides of the enclosure 110. The passive radiators 140, 142, 144, 146 are mounted on the sides of the enclosure 110 so that each passive radiator is opposite another passive radiator. The active transducers 120, 122 are operated in phase causing their respective acoustic outputs to be summed, whereas (by virtue of their mounting on opposite sides of the enclosure 110) the mechanical force components will be out of phase and will cancel.

The configuration in FIG. 1 yields a stable inertial frame of reference resulting in reaction force cancellation. This results in improved articulation and prevents the enclosure 110 from bouncing or moving across the floor.

The enclosure 110 in FIG. 1 has six sides. In other implementations, the enclosure 110 may have more than six sides with either an active transducer or a passive radiator mounted on each side. Ai enclosure such as the enclosure 110 should have enough sides to allow for a 2:1 passive radiator to active transducer ratio to maximize performance capability.

The enclosure 110 in FIG. 1 has either a passive radiator 140, 142, 144, 146 or an active transducer 120, 122 on each side. This facilitates maximizing the volume displacement capability of the compact enclosure 110. All sides of the enclosure 110 are useful radiators, i.e., volume displacers. A compact enclosure of this design may have increased low frequency output capability over a conventional compact enclosure using one transducer and one or two passive radiators or port tubes. Current state of the art generally utilizes between 5% to 15% of the enclosure surface area for acoustic output. The example configuration in FIG. 1 results in approximately 35% of the enclosure 110 surface area being utilized for useful acoustic output, which can translate to a 3 to 9 dB increase in acoustic output capability for the same size enclosure.

Due to the opposing side mounting stipulated above, this compact enclosure 110 may also result in a mechanically stable design and will not have the tendency to move itself across, or off, the floor while operating at high outputs. This may also result in a stable frame of reference for each transducer diaphragm reducing Doppler type distortion of low amplitude signals in the presence of large amplitude signals.

In the example shown in FIG. 1, the enclosure 110 does not contain an amplifier, or any other electronic module. The signal line 160 connects directly to the active transducers 120, 122 from an external amplifier to provide the audio signal that drives the active transducers 120, 122. An amplifier or other electronic module may be mounted in the enclosure 110 itself, although this may limit the amount of area of a side of the enclosure that may be used to mount a passive radiator.

FIG. 1 shows the enclosure 110 with single active transducers 120, 122 and single passive radiators 140, 142, 144, 146 on the sides of the enclosure 110. Each single active transducer 120, 122 may be replaced by multiple active transducers; and each single passive radiator 140, 142, 144, 146 may be replaced by multiple passive radiators. For example, the active transducers 120, 122 in FIG. 1 may each be replaced by two or more active transducers. Thus, the single active transducers 120, 122, 260 described with reference to FIGS. 1 and 2 may be active transducer assemblies each having at least one active transducer. Similarly, the passive radiators 140, 142, 144, 146 in FIG. 1 may each be replaced by two or more passive radiators. Thus, the single passive radiators 140, 142, 144, 146, 280, 282 described with reference to FIGS. 1 and 2 may be passive radiator assemblies each having at least one passive radiator. Additionally, it is not necessary that all the active transducers 120, 122 and passive radiators 140, 142, 144, 146 in a single system be either single or multiple transducers or radiators. A single enclosure may have either single or multiple transducers or radiators on each side of the enclosure. For example, one system design may have multiple active transducers on opposing sides of the enclosure while remaining sides of the enclosure may have single passive radiators. Further, in another implementation, active transducers may be paired with passive radiators on a single side of the enclosure.

Figure 2:
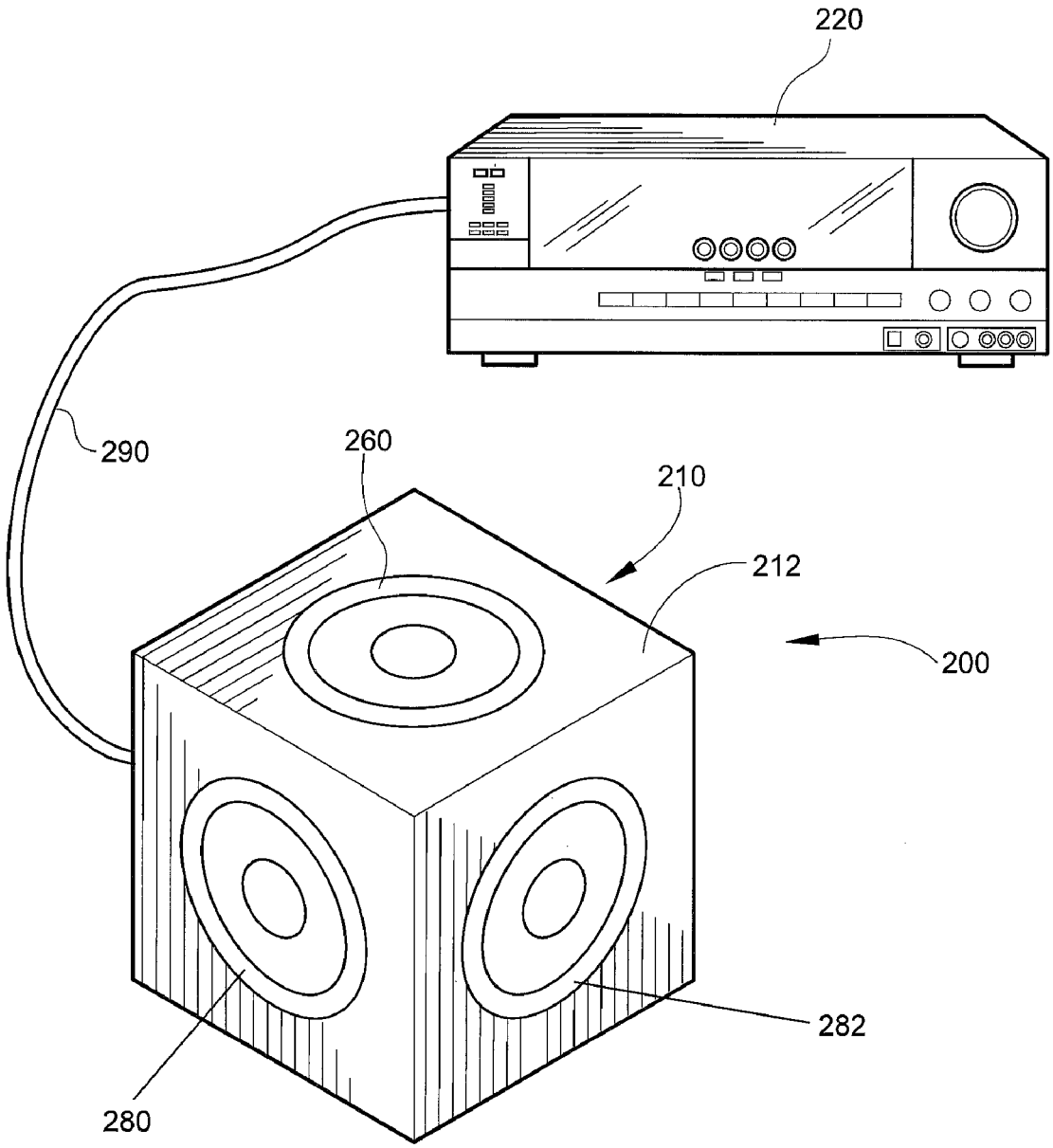
FIG. 2 is a schematic representation of an example of a system that makes use of the speaker system of FIG. 1.

FIG. 2 shows part of an example implementation of a sound system 200 that uses an example of the speaker system 100 of FIG. 1. The system 200 as shown in FIG. 2 includes a subwoofer 210 and an external amplifier 220. The subwoofer 210 includes an enclosure 212, four passive radiators mounted on the sides of the enclosure 212, and two active transducers. A first active transducer 260 is mounted on top of the enclosure 212 and a second active transducer (hidden by the view) is mounted on the bottom of the enclosure 212. A first passive radiator 280 is mounted on one side of the enclosure 212 and a second passive radiator 282 is mounted on a second side of the enclosure 212. The third and fourth passive radiators on the subwoofer 210 in FIG. 2 are hidden by the perspective view. Only one subwoofer 210 is shown in FIG. 2; however, the system 200 may employ any number of subwoofers.

The external amplifier 220 couples an audio signal to the subwoofer 210 over an audio signal line 290. The external amplifier 220 may provide any or all of the following:

the ability to connect a single or multiple subwoofers using individual subwoofer modules for each subwoofer, the ability to insert or exchange equalizer or limiter boards optimized for operation of different subwoofer modules, and a remote control setup.

The remote control setup may allow a listener to calibrate or adjust the system 200 from the listening position by adjusting parameters such as level, phase, polarity, or equalizer options via analog or digital means.

The external amplifier 220 and the subwoofer 210 may be part of an audio and/or visual system having additional speakers and components. Because such a system may have any configuration, description of additional details of an example system are not necessary.

The foregoing description of an implementation has been presented for purposes of illustration and description. It is not exhaustive and does not limit the claimed inventions to the precise form disclosed. Modifications and variations are possible in light of the above description or may be acquired from practicing the invention. For example, the described implementation includes software but the invention may be implemented as a combination of hardware and software or in hardware alone. Note also that the implementation may vary between systems. The claims and their equivalents define the scope of the invention.

What is claimed is:

1. A speaker system comprising:

an enclosure having at least six sides;

at least two active transducer assemblies, each active transducer assembly including at least one active transducer, mounted on the enclosure, each active transducer assembly oriented to project from opposite sides of the enclosure; and at least four passive radiator assemblies, each passive radiator assembly including at least one passive radiator, mounted on the enclosure, each passive radiator assembly oriented to project from opposite sides of the enclosure, where the number of active transducer assemblies plus passive radiator assemblies equals the number of sides on the enclosure.

2. The speaker system of claim 1 where there are two passive radiator assemblies for each active transducer assembly.

3. The speaker system of claim 1 where the enclosure is substantially cube-shaped, the active transducer assemblies are mounted on two opposite sides and the passive radiator assemblies are mounted on the remaining four sides.

4. The speaker system of claim 1 where the active transducer assemblies are mounted on opposite sides to project directly away from each other.

5. The speaker system of claim 1 where the passive radiator assemblies are mounted on opposite sides to project directly away from each other.

6. The speaker system of claim 1 her comprising a connector to connect a wire operable to couple an audio signal to the active transducers.

7. A system comprising:

an external amplifier connected to a plurality of speakers, the amplifier operable to couple audio signals to the speakers;

at least one of the plurality of speakers including a subwoofer, the subwoofer having:

an enclosure with at least six sides;

at least two active transducer assemblies mounted on the enclosure, each active transducer assembly is oriented to project from opposite sides; and at least four passive radiator assemblies mounted on the enclosure, each passive radiator assembly is oriented to project from one of the sides, where the number of active transducer assemblies plus passive radiator assemblies equals the number of sides on the enclosure.

8. The system of claim 7 further comprising a controller module operable to provide user control of the external amplifier.

9. The system of claim 7 further comprising a speaker controller operable to provide user control of the plurality of speakers.

10. The system of claim 7 where the enclosure of the at least one subwoofer is substantially cube-shaped, the active transducer assemblies are mounted on two opposite sides and the passive radiator assemblies are mounted on the remaining four sides.

11. The system of claim 7 where the active transducer assemblies in at least one of the subwoofers are mounted oil opposite sides in the enclosure to project directly away from each other.

12. The system of claim 7 where the passive radiator assemblies in the at least one of the subwoofers are mounted on opposite sides to project directly away from each other.

13. The system of claim 7 where the passive radiators in the at least one of the subwoofers are mounted on opposite sides to project directly away from each other.

14. A subwoofer comprising:

an enclosure having six sides;

two active transducers mounted on the enclosure, each active transducer oriented to project from opposing sides; and four passive radiators mounted on the enclosure, each passive radiator mounted to project from each of the remaining sides.

15. The subwoofer of claim 14 where a first one of the two active transducers is mounted on the top side of the enclosure and the second one of the two active transducers is mounted on the bottom side of the enclosure.

* * * * *

UNITED STATES PATENT AND TRADEMARK OFFICE

CERTIFICATE OF CORRECTION

PATENT NO. : 7,953,239 B2
APPLICATION NO. : 11/676201
DATED : May 31, 2011
INVENTOR(S) : William Andrew Decanio It is certified that error appears in the above-identified patent and that said Letters Patent is hereby corrected as shown below:

Column 2, line 33, “Ai enclosure” should be changed to --An enclosure--
Claim 6, line 34, “her comprising” should be changed to --further comprising--
Claim 11, line 65, “mounted oil” should be changed to --mounted on--

Signed and Sealed this
Eighteenth Day of October, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,953,239 B2
APPLICATION NO. : 11/676201
DATED : May 31, 2011
INVENTOR(S) : William Andrew Decanio It is certified that error appears in the above-identified patent and that said Letters Patent is hereby corrected as shown below:

Column 2, line 33, "Ai enclosure" should be changed to --An enclosure--
Column 4, line 34 (claim 6, line 1) "her comprising" should be changed to --further comprising--
Column 4, line 65 (claim 11, line 2) "mounted oil" should be changed to --mounted on--

This certificate supersedes the Certificate of Correction issued October 18, 2011.

Signed and Sealed this
Twenty-second Day of November, 2011

David J. Kappos

David J. Kappos
*Director of the United States Patent and Trademark Office*